US010310402B2

(12) United States Patent
Kinokuni et al.

(10) Patent No.: US 10,310,402 B2
(45) Date of Patent: Jun. 4, 2019

(54) IMAGE FORMING APPARATUS AND CARTRIDGE HAVING CHARGING ROLLER

(71) Applicant: CANON KABUSHIKI KAISHA, Tokyo (JP)

(72) Inventors: Jiro Kinokuni, Abiko (JP); Kota Mori, Abiko (JP); Yuya Nagatomo, Toride (JP); Michihiro Yoshida, Nagareyama (JP); Takeshi Fujino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/006,945

(22) Filed: Jun. 13, 2018

(65) Prior Publication Data

US 2018/0364637 A1 Dec. 20, 2018

(30) Foreign Application Priority Data

Jun. 15, 2017 (JP) ..... 2017-118137

(51) Int. Cl.
*G03G 15/02* (2006.01)
*G03G 15/00* (2006.01)
*G03G 5/00* (2006.01)

(52) U.S. Cl.
CPC ..... *G03G 15/0216* (2013.01); *G03G 15/0233* (2013.01); *G03G 5/00* (2013.01);
(Continued)

(58) Field of Classification Search
CPC ..... G03G 15/0216; G03G 15/0266; G03G 15/0233; G03G 2215/021
(Continued)

(56) References Cited

U.S. PATENT DOCUMENTS 5,359,395 A 10/1994 Shimura et al.
5,430,527 A * 7/1995 Maruyama ..... G03G 5/047 399/176
(Continued)

FOREIGN PATENT DOCUMENTS

JP H07-098536 A 4/1995
JP H112996 A 1/1999
(Continued)

OTHER PUBLICATIONS

U.S. Appl. No. 16/006,072, filed Jun. 12, 2018.
(Continued)

*Primary Examiner* — Robert B Beatty
(74) *Attorney, Agent, or Firm* — Venable LLP

(57) ABSTRACT

An image forming apparatus includes a photosensitive member having a surface having elastic deformation power of 47% or more, a charging roller forming a nip between itself and the photosensitive member, and an image forming portion. When a nip region corresponding to the nip is formed and then an area of independent contact portions between the charging member and a measuring contact member is measured, the following relationship is satisfied: (contact width X)×(Contact area ratio α)≤0.1, where a length from a position of one end to a position of the other end of the nip region with respect to a direction perpendicular to a longitudinal direction of the charging roller is the contact width X, and a ratio of a sum of areas of the independent contact portions to an entire area of a measuring region is the contact area ratio α.

8 Claims, 9 Drawing Sheets

(52) U.S. Cl.
CPC ..... *G03G 15/0266* (2013.01); *G03G 15/751* (2013.01); *G03G 2215/021* (2013.01)

(58) Field of Classification Search
USPC ..... 399/176
See application file for complete search history.

(56) References Cited

U.S. PATENT DOCUMENTS

| | | | | |
|---|---|---|---|---|
| 6,128,462 | A | 10/2000 | Kato et al. | |
| 6,169,869 | B1 | 1/2001 | Inami et al. | |
| 6,175,703 | B1 | 1/2001 | Nakazono et al. | |
| 6,337,964 | B2 | 1/2002 | Inami et al. | |
| 6,539,190 | B2 | 3/2003 | Oba et al. | |
| 6,898,401 | B2 | 5/2005 | Okano et al. | |
| 6,963,706 | B2 | 11/2005 | Morioka et al. | |
| 7,398,040 | B2 | 7/2008 | Yoshida | |
| 7,551,878 | B2 | 6/2009 | Ogaki et al. | |
| 9,335,643 | B2 | 5/2016 | Nishida et al. | |
| 9,501,032 | B2 | 11/2016 | Kawasaki et al. | |
| 2008/0019735 | A1 | 1/2008 | Ogaki et al. | |
| 2011/0008070 | A1 | 1/2011 | Sato | |
| 2015/0003873 | A1* | 1/2015 | Sato | G03G 15/0233 399/176 |
| 2015/0016843 | A1* | 1/2015 | Kawasaki | G03G 15/0233 399/174 |
| 2016/0154366 | A1* | 6/2016 | Yamauchi | G03G 15/0233 399/176 |
| 2018/0024460 | A1* | 1/2018 | Uematsu | G03G 15/0233 399/176 |

FOREIGN PATENT DOCUMENTS

| | | | |
|---|---|---|---|
| JP | 2000-172053 | A | 6/2000 |
| JP | 2002-214815 | A | 7/2002 |
| JP | 2002-268332 | A | 9/2002 |
| JP | 2006053168 | A | 2/2006 |
| JP | 2006154412 | A | 6/2006 |
| JP | 2007-178588 | A | 7/2007 |
| JP | 4101278 | B2 | 6/2008 |
| JP | 2008-281944 | A | 11/2008 |
| JP | 2010-019990 | A | 1/2010 |
| JP | 2014-115527 | A | 6/2014 |
| JP | 2015-028603 | A | 2/2015 |
| JP | 2015034978 | A | 2/2015 |

OTHER PUBLICATIONS

Extended Search Report in European Patent Application No. 18 175 473.0, dated Sep. 18, 2018.

Office Action in Japanese Patent Application No. 2017-118137, dated Jan. 8, 2019.

* cited by examiner (a)

(b)

IMAGE FORMING APPARATUS AND CARTRIDGE HAVING CHARGING ROLLER

FIELD OF THE INVENTION AND RELATED ART

The present invention relates to an image forming apparatus, such as a copying machine, a printer or a facsimile machine, of an electrophotographic type, and relates to a cartridge for use with the image forming apparatus.

Conventionally, in the image forming apparatus of the electrophotographic type, as a type of electrically charging a photosensitive member (electrophotographic photosensitive member), a contact charging type in which the photosensitive member is charged under application of a voltage to a charging member contacted to the photosensitive member. As the charging member, a roller-shaped charging roller is used in many cases. The charging roller has, for example, a constitution in which an electroconductive elastic layer is provided on an outer peripheral surface of an electroconductive supporting member and on a surface of the electroconductive supporting member, an electroconductive surface layer is coated.

In the contact charging type, the surface of the photosensitive member is charged by electric discharge generating in a small gap between the photosensitive member and the charging member. The contact charging type includes an "AC charging type" in which a voltage in the form of a DC voltage biased with an AC voltage is applied to the charging member and a "DC charging type" in which only a DC voltage is applied to the charging member.

On the other hand, in Japanese Laid-Open Patent Application (JP-A) 2006-53168, abrasion (wearing) of the surface of the photosensitive member is suppressed by increasing a hardness (i.e., decreasing a wearing degree) of a surface layer of the photosensitive member by providing a protective layer high in elastic deformation rate (elastic deformation power) as the surface layer of the photosensitive member, so that lifetime extension has been realized. However, when the degree of abrasion of the photosensitive member surface is excessively suppressed, an electric discharge product deposited on the photosensitive member surface has the influence on an image in some cases. This is caused by that the discharge product has a property such that deliquescency of the discharge product is high.

In a constitution of JP-A Hei 11-2996 in which an AC charging type is employed and a surface layer of a photosensitive member is increased in hardness (i.e., decreased in wearing degree), principally in a high humidity environment, an image flow such that the surface of the photosensitive member is lowered in resistance and thus the electrostatic image cannot be held on the photosensitive member surface occurs in some cases. Therefore, in this constitution, a means for polishing the photosensitive member surface or a means for applying a lubricant onto the photosensitive member surface is provided. However, provision of such a constitution for removing the discharge product leads to one of causes of prevention of downsizing and cost reduction of the image forming apparatus.

On the other hand, in the DC charging type, compared with the AC charging type, an amount of the electric discharge is small. For that when a constitution in which the surface layer of the photosensitive member is increased in hardness (i.e., decreased in wearing degree) by employing the DC charging type is used, it would be considered that not only the lifetime extension of the photosensitive member can be realized by suppressing the degree of abrasion of the photosensitive member surface but also the cost reduction can be realized by reducing necessity that the constitution for removing the discharge product or the like.

However, even in the DC charging type, deposition of the discharge product on the photosensitive member surface generates although an amount thereof is small compared with the case of the AC charging type, so that the photosensitive member surface is lowered in resistance. Further, according to study of the present inventors, it turned out that in the constitution in which the DC charging type is employed and the surface layer of the photosensitive member is increased in hardness (i.e., decreased in wearing degree), a charge injection phenomenon occurs at a contact portion between the photosensitive member and the charging member due to the generation of the discharge product, and thus an image is disturbed.

SUMMARY OF THE INVENTION

According to an aspect of the present invention, there is provided an image forming apparatus comprising: a rotatable photosensitive member having a surface having elastic deformation power of 47% or more; a charging roller including an elastic layer and configured to electrically charge the photosensitive member under application of only a DC voltage, wherein the charging roller forms a nip with elastic deformation along the surface of the photosensitive member by being urged against the photosensitive member with a predetermined urging force, and in the nip, a surface of the charging roller and the surface of the photosensitive member are in contact to each other at a plurality of independent contact portions; and an image forming portion configured to form a toner image on the photosensitive member charged by the charging roller, wherein when a nip region corresponding to the nip is formed by urging the charging roller against a measuring contact member with the predetermined urging force and then an area of a plurality of independent contact portions at which the surface of the charging member and the measuring contact member are in contact to each other is measured, the following relationship is satisfied: (Contact width X)(mm)×(Contact area ratio $\alpha$)≤0.1 (mm), where a length from a position of one end to a position of the other end of the nip region with respect to a direction perpendicular to a longitudinal direction of the charging roller is the contact width X, and a ratio of a sum of areas ($mm^2$) of the independent contact portions to an entire area ($mm^2$) of a measuring region in which the independent contact portions are provided is the contact area ratio $\alpha$, wherein the measuring region is a rectangular region in which one edge has a unit length (mm) extending in the longitudinal direction of the charging member and another edge has the contact width X (mm) extending in the direction perpendicular to the longitudinal direction of the charging roller and which falls within the nip region.

According to another aspect of the present invention, there is provided a cartridge detachably mountable to a main assembly of an image forming apparatus, the cartridge comprising: a rotatable photosensitive member having a surface having elastic deformation power of 47% or more; a charging roller including an elastic layer and configured to electrically charge the photosensitive member under application of only a DC voltage, wherein the charging roller forms a nip with elastic deformation along the surface of the photosensitive member by being urged against the photosensitive member with a predetermined urging force, and in the nip, a surface of the charging roller and the surface of the photosensitive member are in contact to each other at a plurality of independent contact portions, wherein when a nip region corresponding to the nip is formed by urging the charging roller against a measuring contact member with the predetermined urging force and then an area of a plurality of independent contact portions at which the surface of the charging member and the measuring contact member are in contact to each other is measured, the following relationship is satisfied: (Contact width X)(mm)×(Contact area ratio α)≤0.1 (mm), where a length from a position of one end to a position of the other end of the nip region with respect to a direction perpendicular to a longitudinal direction of the charging roller is the contact width X, and a ratio of a sum of areas ($mm^2$) of the independent contact portions to an entire area ($mm^2$) of a measuring region in which the independent contact portions are provided is the contact area ratio α, wherein the measuring region is a rectangular region in which one edge has a unit length (mm) extending in the longitudinal direction of the charging member and another edge has the contact width X (mm) extending in the direction perpendicular to the longitudinal direction of the charging roller and which falls within the nip region.

Further features of the present invention will become apparent from the following description of exemplary embodiments with reference to the attached drawings.

Figure 2:
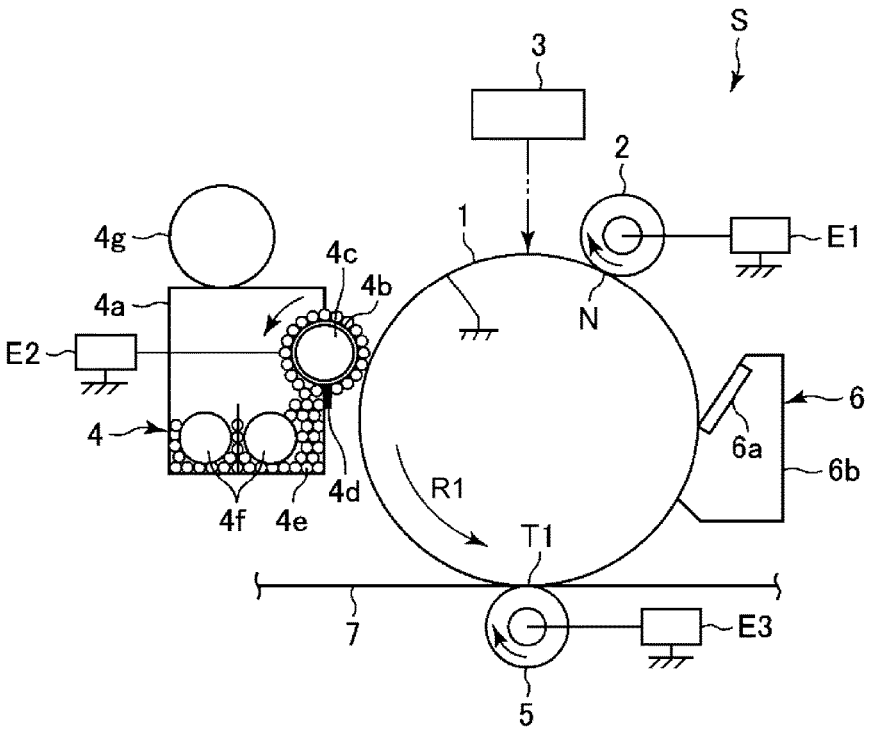
Figure 2:
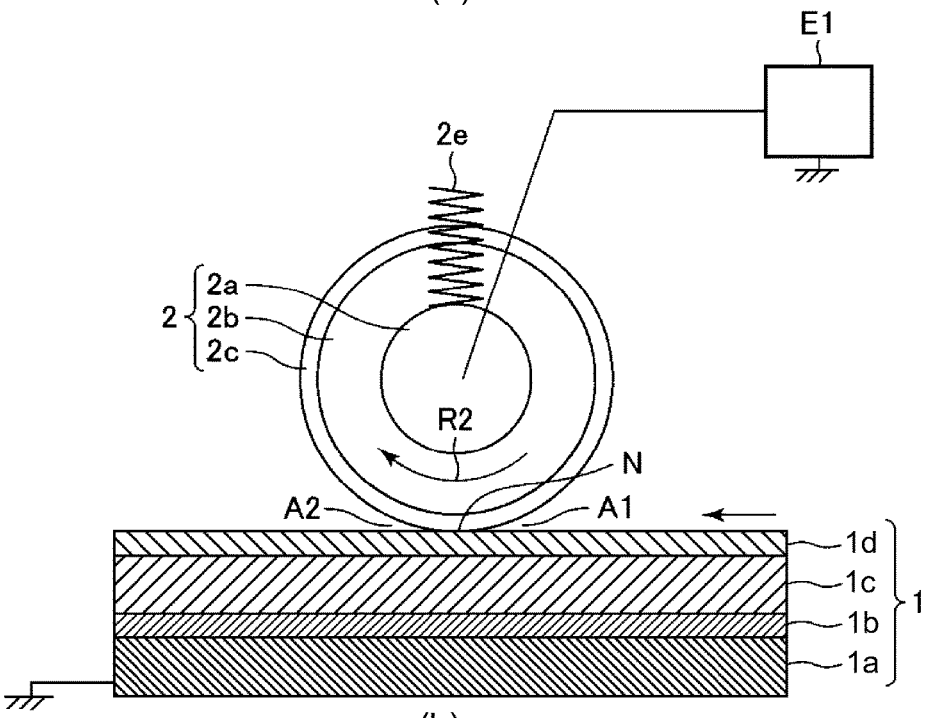

Parts (a) and (b) of FIG. 2 are schematic sectional views each showing an image forming portion, a photosensitive drum and a charging roller.

Figure 3:
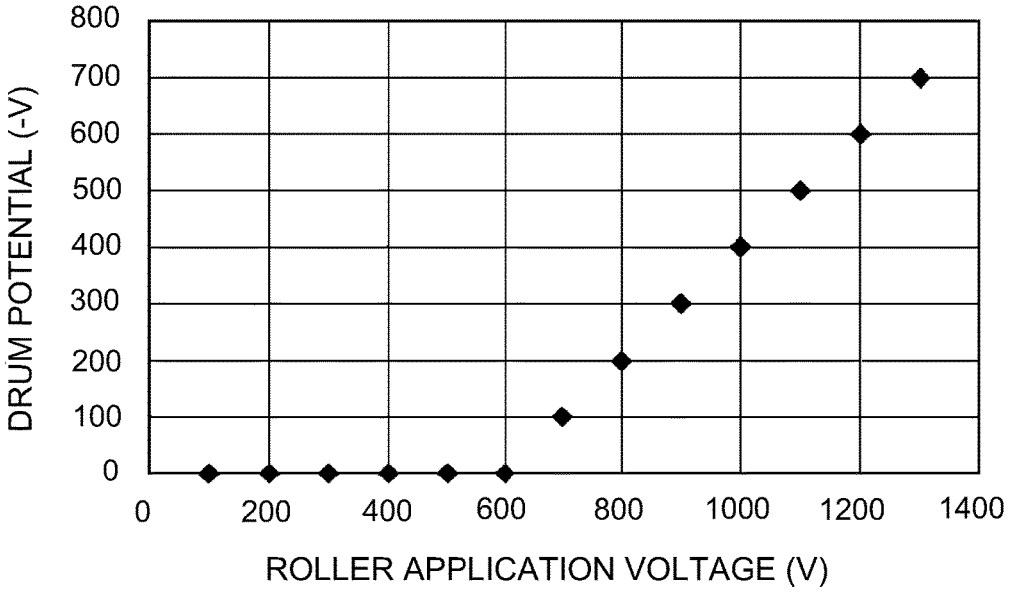

FIG. 3 is a graph showing a relationship between an applied voltage to the charging roller and a surface potential of the photosensitive drum.

Figure 4:
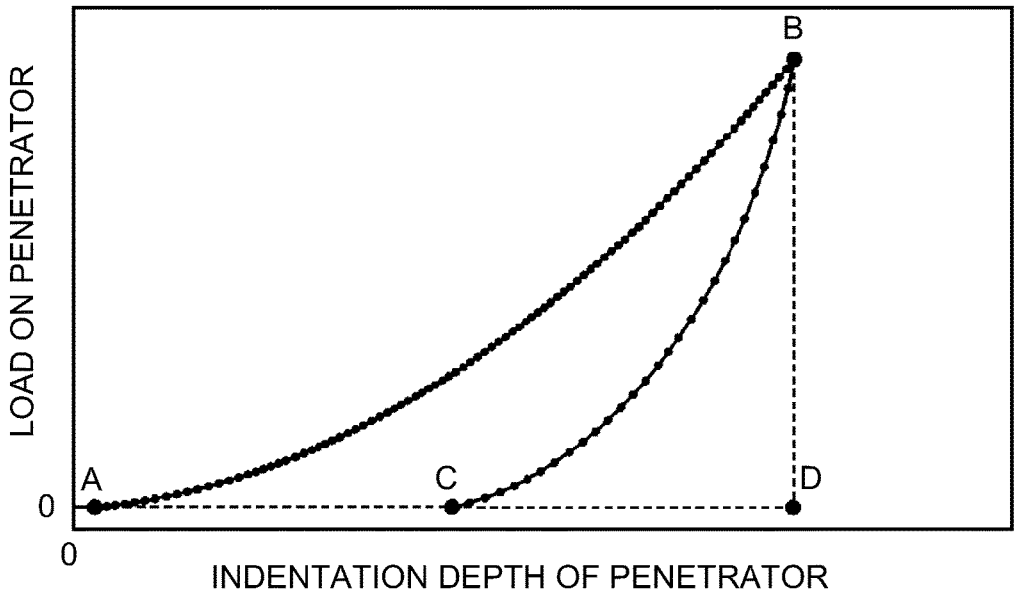

FIG. 4 is a graph for illustrating a measuring method of an elastic deformation rate.

Figure 5:
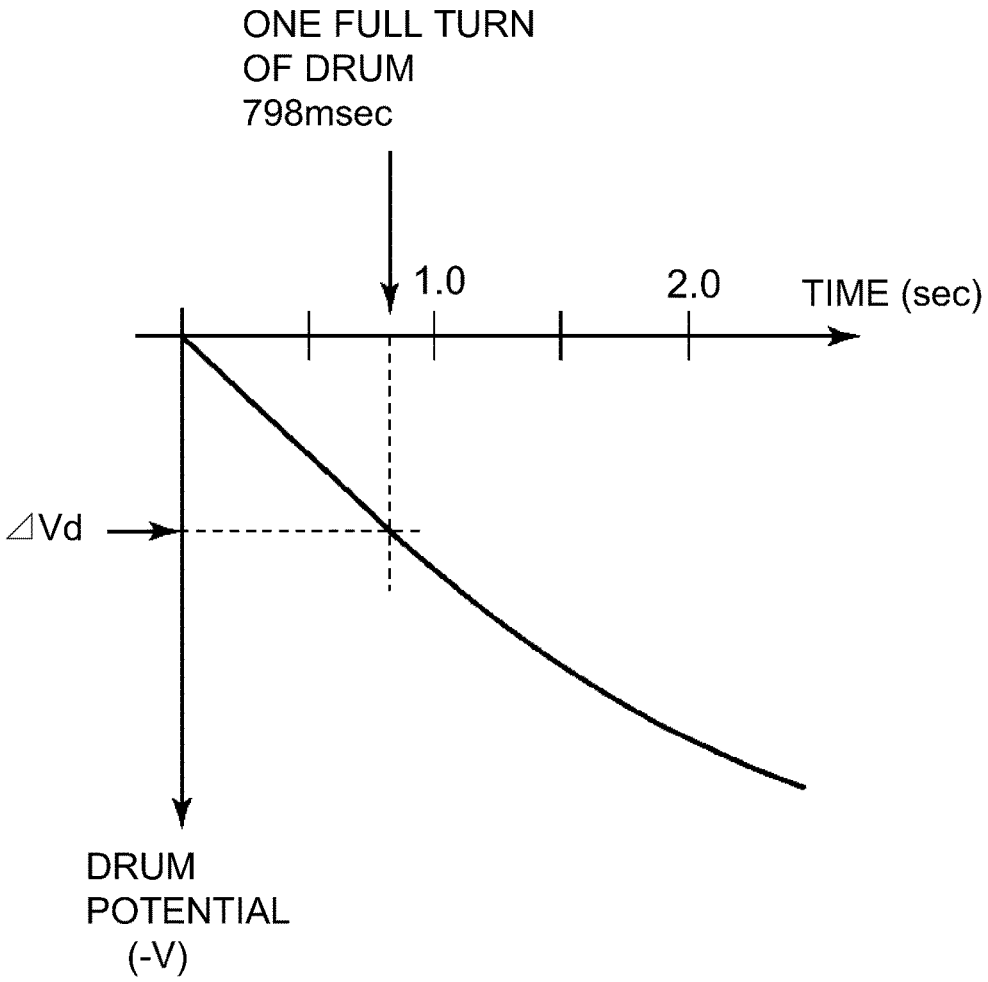

FIG. 5 is a graph showing a charge injection amount measuring result during application of a fixed voltage.

Figure 6:
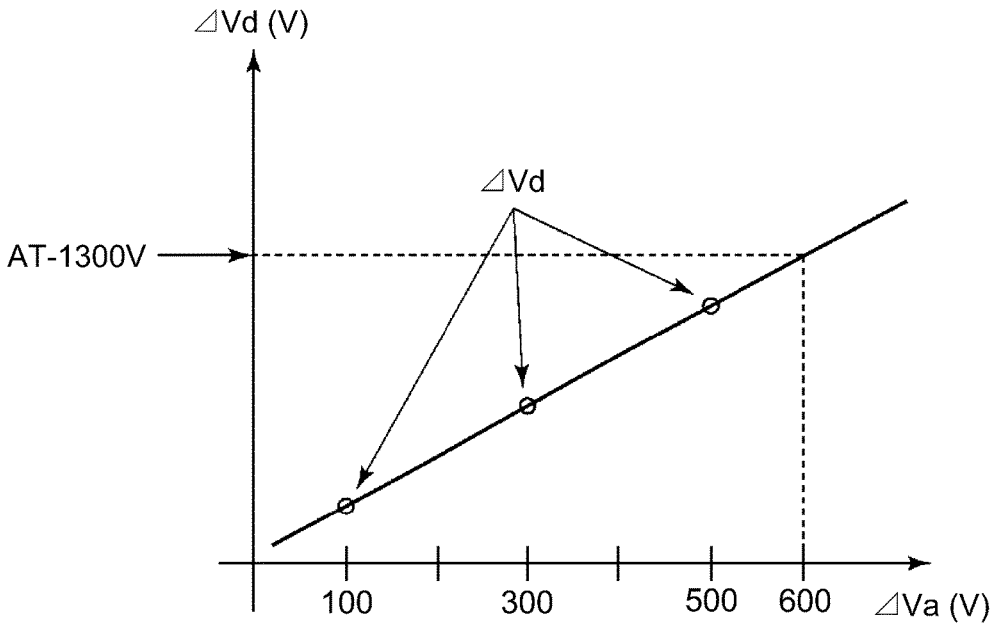

FIG. 6 is a graph showing a charge injection amount measuring result during application of a plurality of voltages.

Figure 7:
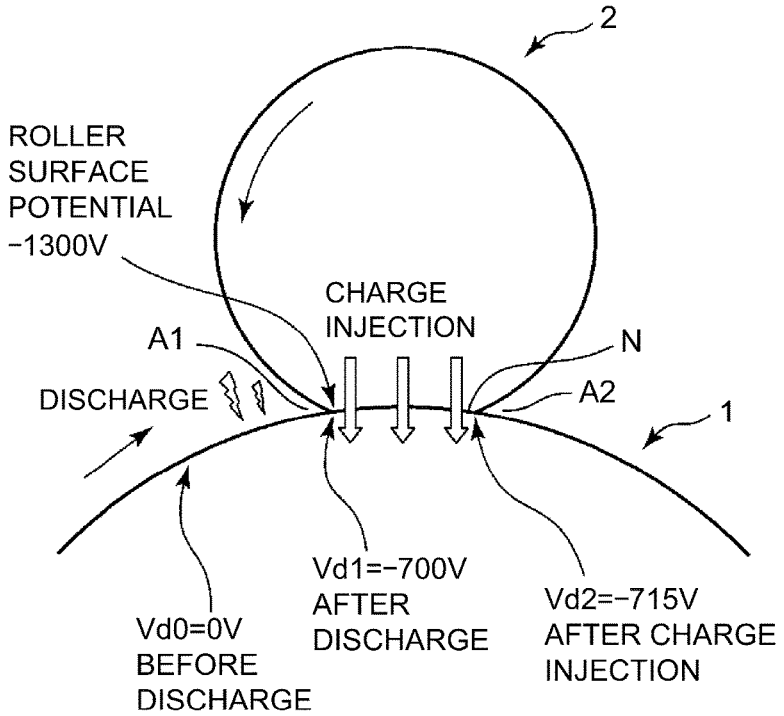

FIG. 7 is a schematic view for illustrating a charge injection phenomenon during image formation.

Figure 8:
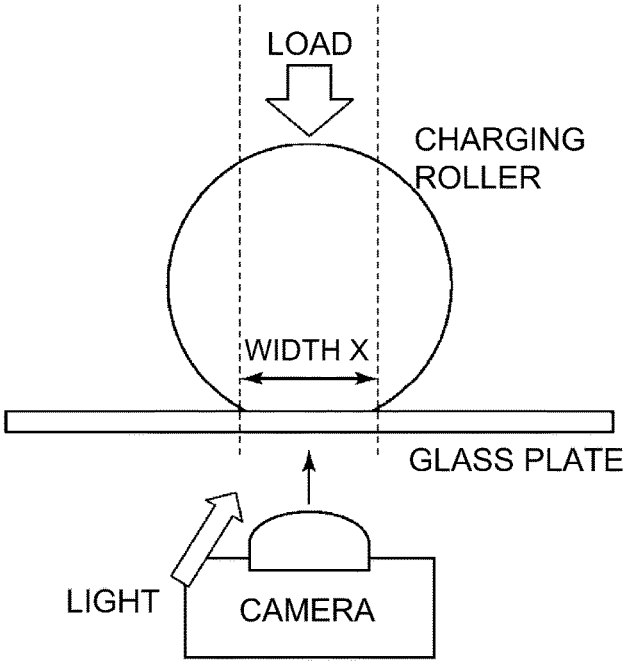

FIG. 8 is a schematic view for illustrating a measuring device of a contact area ratio.

Figure 9:
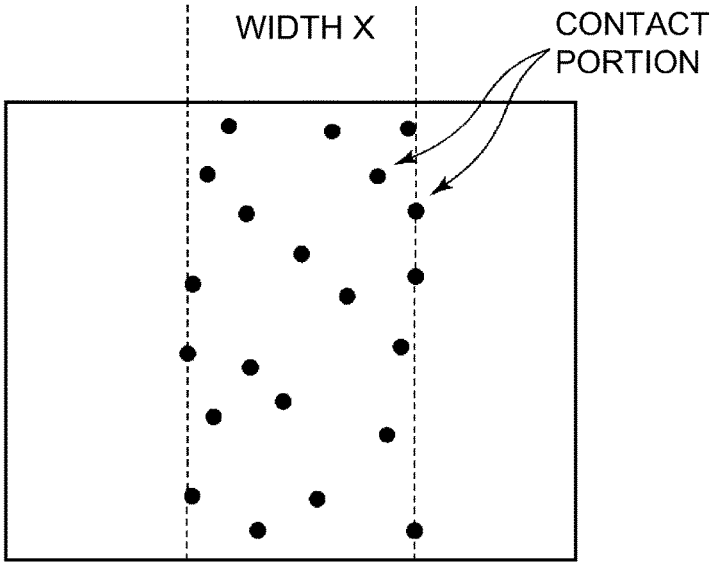

FIG. 9 is a schematic view for illustrating digitization of the contact area ratio.

Figure 10:
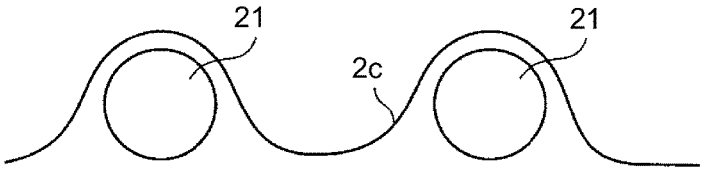

FIG. 10 is a schematic sectional view of a surface layer of the charging roller.

Figure 11:
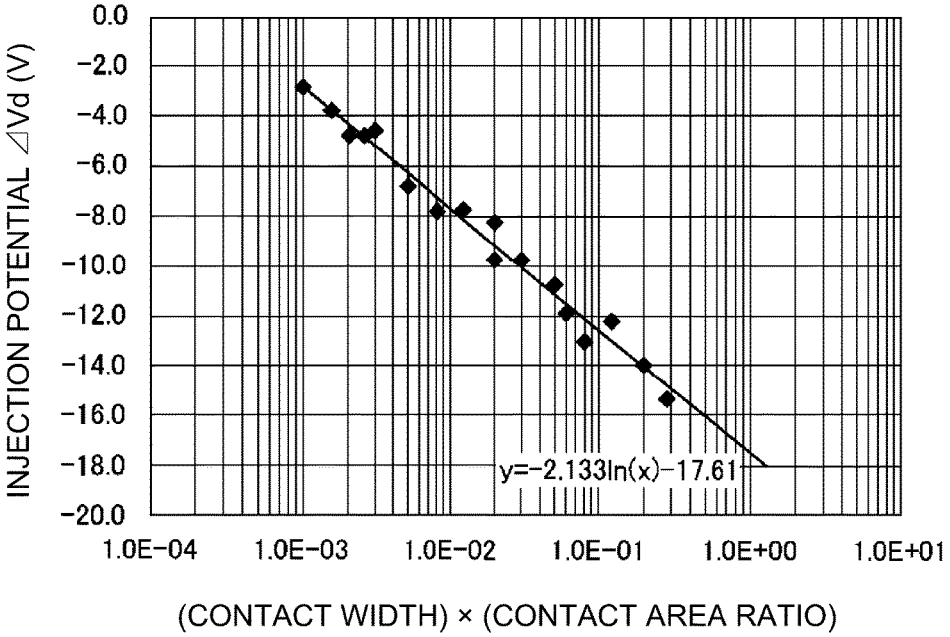

FIG. 11 is a graph showing a relationship between a charge injection potential and a product of a contact width and the contact area ratio.

Figure 12:
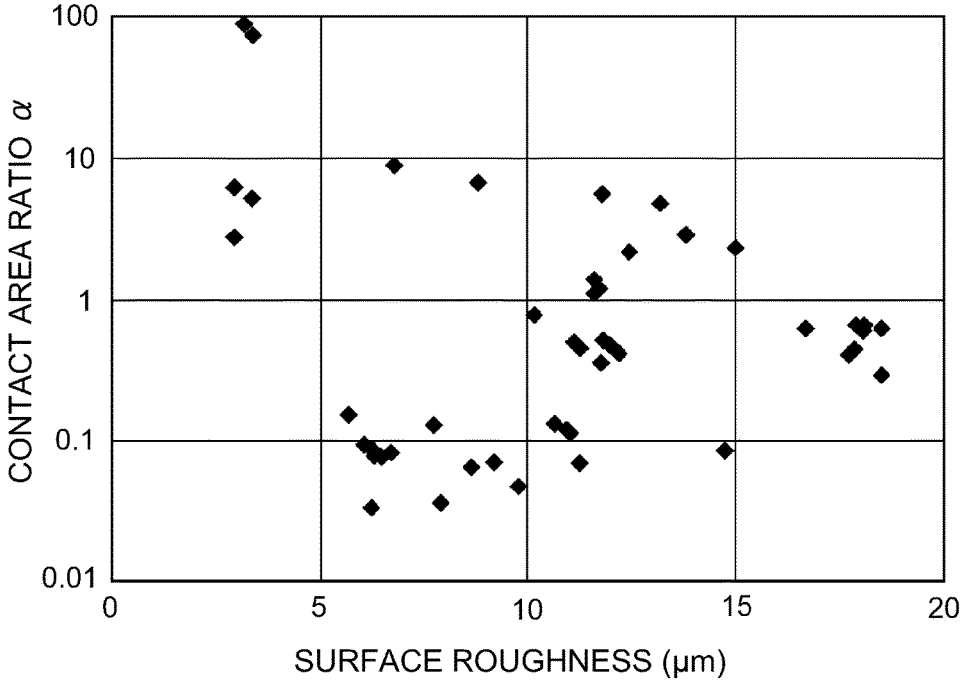

FIG. 12 is a graph showing a relationship between a surface roughness of the charging roller and the contact area ratio.

Figure 13:
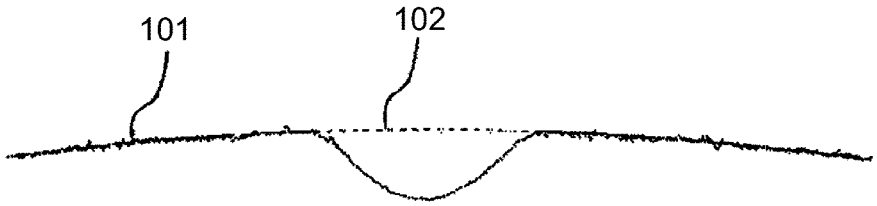

FIG. 13 is a schematic view showing an example of fitting of a surface of the photosensitive drum.

Figure 14:
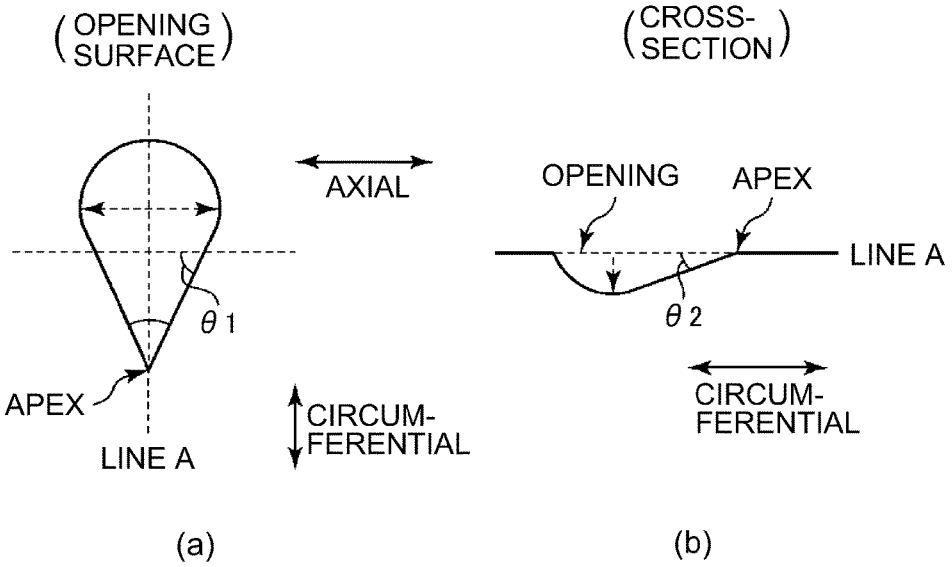

Parts (a) and (b) of FIG. 14 are schematic views for illustrating a shape of a specific recess on the surface of the photosensitive drum.

DESCRIPTION OF THE EMBODIMENTS

An image forming apparatus and a cartridge, which are in accordance with the present invention will be described with reference to the drawings.

Embodiment 1

1. General Constitution and Operation of Image Forming Apparatus

Figure 1:
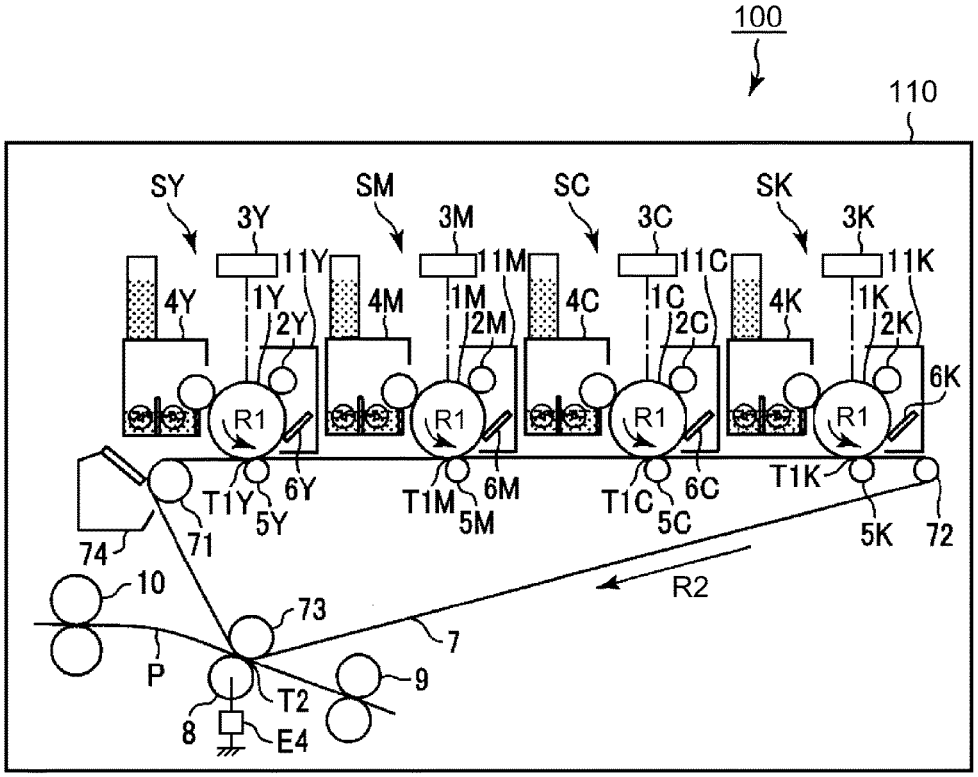
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type (in-line-type) multi-function machine, having functions of a copying machine, a printer and a facsimile apparatus, employing an intermediary transfer type capable of forming a full-color image by using an electrophotographic type. The image forming apparatus 100 of this embodiment employs a contact charging type, particularly a DC charging type and has a constitution in which a curable protective layer is provided as a surface layer of a photosensitive member. This image forming apparatus 100 is capable of forming an image on an A3-size transfer(-receiving material) to the maximum.

The image forming apparatus 100 includes, as a plurality of image forming portions, first to fourth image forming portions SY, SM, SC and SK for forming images of yellow (Y), magenta (M), cyan (C) and black (K), respectively. Incidentally, elements having the same or corresponding functions and constitutions in the respective image forming portions SY, SM, SC and SK are collectively described by omitting suffixes Y, M, C and K for representing elements for associated colors in some cases. Part (a) of FIG. 2 is a schematic sectional view showing a single image forming portion S as a representative. In this embodiment, the image forming portion S is constituted by including a photosensitive drum 1, a charging roller 2, an exposure device 3, a developing device 4, a primary transfer roller 5, a drum cleaning device 6, and the like, which are described later.

The image forming apparatus 100 includes the photosensitive drum 1 which is a rotatable drum-shaped (cylindrical) photosensitive member as an image bearing member.

The photosensitive drum 1 is rotationally driven in an indicated arrow R1 direction at a predetermined peripheral speed (process speed) by a driving motor (not shown) as a driving means. A surface of the rotating photosensitive drum 1 is electrically charged uniformly to a predetermined polarity (negative in this embodiment) and a predetermined potential by the charging roller 2 which is a roller-type charging member as a charging means. During a charging step, to the charging roller 2, from a charging voltage source (high-voltage source circuit) E1 as an applying means, a charging voltage (charging bias) consisting only of a DC voltage (DC component) is applied. The charged surface of the photosensitive drum 1 is subjected to scanning exposure to light by the exposure device 3 as an exposure means (electrostatic image forming means), so that an electrostatic image (electrostatic latent image) is formed on the photosensitive drum 1. In this embodiment, the exposure device 3 is a laser beam scanner using a semiconductor laser.

The electrostatic image formed on the photosensitive drum 1 is developed (visualized) with a developer by the developing device 4, so that a toner image is formed on the photosensitive drum 1. In this embodiment, toner charged to the same polarity as a charge polarity (negative polarity in this embodiment) of the photosensitive drum 1 is deposited on an exposed portion, on the photosensitive drum 1, where an absolute value of a potential is lowered by subjecting the surface of the photosensitive drum 1 to the exposure to the laser beam after uniformly charging the surface of the photosensitive drum 1. That is, in this embodiment, a normal toner charge polarity which is the toner charge polarity during development is the negative polarity. In this embodiment, the developing device 4 uses a two-component developer containing toner (non-magnetic toner particles) as the developer and a carrier (magnetic carrier particles). The developing device 4 includes a developing container 4*a* accommodating a developer 4*e* and a developing sleeve 4*b* provided rotatably to the developing container 4*a* so as to be partly exposed toward an outside through an opening of the developer container 4*a* and formed with a non-magnetic hollow cylindrical member. Inside (at a hollow portion of) the developing sleeve 4*b*, a magnet roller 4*c* is provided fixedly to the developing container 4*a*. The developing container 4*a* is provided with a regulating blade 4*d* so as to oppose the developing sleeve 4*b*. In the developing container 4*a*, two stirring members (stirring screws) 4*f* are provided. Into the developing container 4*a*, the toner is appropriately supplied from a toner hopper 4*g*. The developer 4*e* carried on the developing sleeve by a magnetic force of the magnet roller 4*c* is fed to an opposing portion (developing portion) to the photosensitive drum 1 after an amount thereof is regulated by the regulating blade 4*d* with rotation of the developing sleeve 4*b*. The developer on the developing sleeve 4*b* fed to the developing portion erected by the magnetic force of the magnet roller 4*c* and forms a magnetic brush (magnetic chain), so that the developer is contacted to or brought near to the surface of the photosensitive drum 1. During the development, to the developing sleeve 4*b*, from a developing voltage source (high-voltage source circuit) E2, as a developing voltage (developing bias), an oscillating voltage in the form of a DC voltage (DC component) biased with an AC voltage (AC component) is applied. In this embodiment, the DC voltage is −550 V, and the AC voltage is 8 kHz in frequency and 1800 V in a peak-to-peak voltage Vpp. As a result, depending on the electrostatic image on the photosensitive drum 1, the toner is moved from the magnetic brush on the developing sleeve 4*b* onto the photosensitive drum 1, so that the toner image is formed on the photosensitive drum 1.

An intermediary transfer belt 7 constituted by an endless belt as an intermediary transfer member is provided so as to oppose the respective photosensitive drums 1. The intermediary transfer belt 7 is extended around a driving roller 71, a tension roller 72 and a secondary transfer opposite roller 73 which are used as stretching rollers, and is stretched with a predetermined tension. The intermediary transfer belt 7 is rotated (circulated) by rotationally driving the driving roller 71 in an indicated arrow R2 direction at a peripheral speed substantially equal to the peripheral speed of the photosensitive drum 1. In an inner peripheral surface side of the intermediary transfer belt 7, a primary transfer roller 5 which is a roller-type primary transfer member as a primary transfer means is provided corresponding to the associated photosensitive drum 1. The primary transfer roller 5 is pressed (urged) against the intermediary transfer belt 7 toward the photosensitive drum 1, so that a primary transfer portion (primary transfer nip) T1 where the photosensitive drum 1 and the intermediary transfer belt 7 contact each other is formed.

The toner image formed on the photosensitive drum 1 is primary-transferred by the action of the primary transfer roller 5 onto the intermediary transfer belt 7 at the primary transfer portion T1. During a primary transfer step, to the primary transfer roller 5, a primary transfer voltage (primary transfer bias) which is a DC voltage of an opposite polarity to the normal charge polarity of the toner is applied from a primary transfer voltage source (high-voltage source circuit) E3. In this embodiment, the primary transfer voltage is set at +500 V. For example, during full-color image formation, the respective color toner images of yellow, magenta, cyan and black formed on the respective photosensitive drums 1 are successively transferred superposedly onto the intermediary transfer belt 7.

At a position opposing the secondary transfer opposite roller 73 on an outer peripheral surface side of the intermediary transfer belt 7, a secondary transfer roller 8 which is a roller-type secondary transfer member as a secondary transfer means is provided. The secondary transfer roller 8 is pressed (urged) against the intermediary transfer belt 7 toward the secondary transfer opposite roller 73 and forms a secondary transfer portion (secondary transfer nip) T2 where the intermediary transfer belt 7 and the secondary transfer roller 8 are in contact with each other. The toner images formed on the intermediary transfer belt 7 as described above secondary-transferred by the action of the secondary transfer roller 8 onto a transfer(-receiving) material (sheet, recording material) P, such as a recording sheet, nipped and fed at the secondary transfer portion T2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner is applied from a secondary transfer voltage source (high-voltage source circuit) E4. The transfer material P is fed one by one by a feeding device (not shown) and then is conveyed to a registration roller pair 9, and thereafter, the transfer material P is timed to the toner images on the intermediary transfer belt 7 and then is supplied to the secondary transfer portion T2 by the registration roller pair 9. Further, the transfer material P on which the toner images are transferred is fed to a fixing device 10 and is heated and pressed by the fixing device 10, so that the toner images are fixed (melt-fixed) on the transfer material P. Thereafter, the transfer material P on which the toner images are fixed is discharged (outputted) to an outside of the apparatus main assembly 110 of the image forming apparatus 100.

On the other hand, toner (primary transfer residual toner) remaining on the photosensitive drum 1 during the primary transfer is removed and collected from the surface of the photosensitive drum 1 by a drum cleaning device 6 as a photosensitive member cleaning means. The drum cleaning device 6 includes a cleaning blade 6*a* as a cleaning member and includes a cleaning container 6*b*. The drum cleaning device 6 rubs the surface of the rotating photosensitive drum 1 with the cleaning blade 6*a*. As a result, the primary transfer residual toner on the photosensitive drum 1 is scraped off the surface of the photosensitive drum 1 and is accommodated in the cleaning container 6*b*. Further, on an outer peripheral surface side of the intermediary transfer belt 7, a belt cleaning device 74 as an intermediary transfer member cleaning means is provided at a position opposing the driving roller 71. Toner (secondary transfer residual toner) remaining on the surface of the intermediary transfer belt 7 during a secondary transfer step is removed and collected from the surface of the intermediary transfer belt 7 by the belt cleaning device 74.

In this embodiment, at each of the image forming portions S, the photosensitive drum 1, the charging roller 2, and the drum cleaning device 6 integrally constitute a cartridge (drum cartridge) 11 detachably mountable to the apparatus main assembly 110.

2. Photosensitive Member and Charging Member

Next, the photosensitive member and the charging member in this embodiment will be specifically described.

<Photosensitive Member>

Part (b) of FIG. 2 is a schematic sectional view showing layer structures of the photosensitive drum 1 and the charging roller 2. In this embodiment, the photosensitive drum 1 is a negatively chargeable drum-shaped organic photosensitive member (OPC) in which an original material is used as a photo-conductive material (charge generating material and charge transporting material). In this embodiment, an outer diameter of the photosensitive drum 1 is 30 mm, and when an image is formed on plain paper as a transfer (toner image receiving) material, the photosensitive drum is rotationally driven at the peripheral speed (process speed) of 120 mm/s. As shown in part (b) of FIG. 2, this photosensitive drum 1 has a lamination structure in which on a substrate (electroconductive substrate) la, three layers consisting of a charge generating layer 1*b*, a charge transporting layer 1*c* and a protective layer 1*d* are laminated from below in a named order. In this embodiment, the substrate 1*a* is constituted by an aluminum cylinder. Further, between the substrate 1*a* and the charge generating layer 1*b*, an undercoat layer for suppressing interference of light and for improving an adhesive property of an upper layer may also be provided.

In this embodiment, in order to realize lifetime extension of the photosensitive drum 1, hardness of the surface layer (a layer positioned at an outermost surface of the photosensitive drum 1 (i.e., an outermost layer)) of the photosensitive drum 1 is increased (i.e., a wearing degree is lowered). In this embodiment, as the surface layer of the photosensitive drum 1, the protection layer 1*d* formed with a curable resin material as a binder resin material is provided. In this embodiment, the protective layer 1*d* is formed using a curable phenolic resin material as the binder resin material. Incidentally, the binder resin material of the surface layer of the photosensitive drum 1 is not limited thereto, but an arbitrary available curable material can be used. For example, a technique such that a cured film obtained by curing a monomer having a C═C (double) bond with heat or light energy is used as the surface layer of the photosensitive drum 1. Further, in this embodiment, the surface layer of the photosensitive drum 1 is the protective layer, but this protective layer may also contain electroconductive particles. The surface layer of the photosensitive drum 1 may also have, in addition to a function as the protective layer, a function as the charge transporting layer (even when another charge transporting layer is provided under the charge transporting layer, these layers may also be regarded as substantially a single charge transporting layer) containing a charge transporting material.

<Charging Member>

As shown in part (b) of FIG. 2, the charging roller 2 is rotatably supported by bearing members (not shown) at end portions of the supporting member (electroconductive supporting member, core metal) 2*a* with respect to a rotational axis direction. Further, the charging roller 2 is urged against the surface of the photosensitive drum 1 with a predetermined urging force by urging of the bearing members, provided at the end portions of the supporting member 2*a* with respect to the rotational axis direction, by urging springs 2*e*, respectively, as urging means. The charging roller 2 is rotated by rotation of the photosensitive drum 1. In this embodiment, a length of the charging roller 2 with respect to the rotational axis direction (longitudinal direction) is 320 mm.

The charging roller 2 forms a contact portion (press-contact portion) in contact with the surface of the photosensitive drum 1. The contact portion between the photosensitive drum 1 and the charging roller 2 in the case where the contact portion is macroscopically observed is referred to as "charging nip N". Incidentally, the contact portion at which the photosensitive drum 1 and the charging roller 2 are actually in contact to each other in the case where the contact portion is macroscopically observed will be described later. With an increasing distance from the charging nip N toward each of an upstream side and a downstream side with respect to the rotational direction of the photosensitive drum 1, a gap (charging gap) between the photosensitive drum 1 and the charging roller 2 gradually increases. An upstream minute gap of the charging nip N with respect to the rotational direction of the photosensitive drum 1 is referred to as an "upstream charging gap portion A1". Further, a downstream minute gap of the charging nip N with respect to the rotational direction of the photosensitive drum 1 is referred to as a "downstream charging gap portion A2".

A charging process of the surface of the photosensitive drum 1 is carried by the electric discharge generating between the charging roller 2 and the photosensitive drum 1 in at least one of the upstream charging gap portion A1 and the downstream charging gap portion A2 (in this embodiment, in the upstream charging gap portion A1). FIG. 3 is a graph showing a relationship between a DC voltage applied to the charging roller 2 and a surface potential of the photosensitive drum 1. The surface of the photosensitive drum 1 is charged by the electric discharge by applying a negative(-polarity) voltage having an absolute value which is not less than a threshold voltage to the charging roller 2. In this embodiment, when to the charging roller 2, the negative voltage of about 600 V or more in absolute value is applied, an absolute value of the surface potential of the photosensitive drum 1 starts to increase. In a range of the negative voltage of about 600 V or more in absolute value of the voltage applied to the charging roller 2, the absolute value of the surface potential of the photosensitive drum 1 increases while maintaining a substantially rectilinear relationship with the absolute value of the voltage applied to the charging roller 2. For example, when the voltage of −900 V is applied to the charging roller 2, the surface potential of the photosensitive drum 1 is −300 V. Further, when the voltage of −1100 V is applied to the charging roller 2, the surface potential of the photosensitive drum 1 is −500 V. This threshold voltage (−600 V) is referred to as a "discharge start voltage (charge start voltage) Vth". That is, in order to charge the surface of the photosensitive drum 1 to Vd (dark portion potential), there is a need to apply a DC voltage of Vth+Vth to the charging roller 2. Specifically, the surface potential of the photosensitive drum 1 is changed to Vd by applying the DC voltage of Vd+Vth from the charging voltage source E1 to the charging roller 2. In this embodiment, the surface potential (dark portion potential) Vd of the photosensitive drum 1 formed by charging the charging roller 2 is set at −700 V. For that reason, during the image formation, the DC voltage of −1300 V is applied from the charging voltage source E1 to the charging roller 2. Incidentally, in this embodiment, a surface potential (light portion potential) V1 of the photosensitive drum 1 formed by subjecting the photosensitive drum surface to exposure to laser light by the exposure device 3 is set at −150 V.

Here, a width with respect to the rotational direction of the photosensitive drum 1, of the charging gap portion at which the photosensitive drum 1 is charged by the charging roller 2 through the electric discharge varies depending on the voltage applied to the charging roller 2. That is, the charging gap portion refers to a portion where the photosensitive drum 1 is charged by generation of the electric discharge, but the minute gap for permitting generation of the electric discharge under application of the voltage varies in accordance with the Paschen's law. Incidentally, a gap, between the photosensitive drum 1 and the charging roller 2, corresponding to the surface of the photosensitive drum 1 charged in the case where the voltage is applied to the charging roller 2 in a state in which rotation of the photosensitive drum 1 is stopped corresponds to the charging gap portion.

As shown in part (b) of FIG. 2, the charging roller 2 has a lamination structure in which on the supporting member (core metal) 2*a*, a base layer (electroconductive elastic layer) 2*c* and a surface layer (outermost layer) 2*c* are provided in a named order.

The supporting member 2*a* is a shaft made of metal (chromium-plated iron) in this embodiment. The base layer 2*b* can be formed with a rubber, thermoplastic elastomer or the like suitable as a material of the base layer of the charging member. Specifically, the base layer 2*b* can be formed using a hydrin-based rubber material (epichlorohydrin) or an urethane-based rubber material (polyurethane). Further, the surface layer 2*c* can be formed of a resin material suitable as a material for forming the surface of the charging member. Specifically, the surface layer 2*c* can be formed using an acrylic resin material or a nylon-based resin material. The surface layer 2*c* imparts an anti-wearing (abrasion) property against the photosensitive drum 1 to the charging roller 2. In addition, the surface layer 2*c* has a function of suppressing leakage of a current in the case where a pinhole generates on the photosensitive drum 1 and has a function of suppressing contamination of the charging roller 2 with the toner or an external additive externally added to the toner. Particularly, in this embodiment, the base layer 2*b* is formed using epichlorohydrin, and the surface layer 2*c* is formed using an acrylic resin material. Incidentally, electroconductivity can be imparted to or adjusted for the base layer 2*b* and the surface layer 2*c* by adding an electroconductive agent.

FIG. 10 is a schematic enlarged view of the surface layer 2*c*. In the material forming the surface layer 2*c*, surface (layer) particles 21 are dispersed. As the surface particles 21 added (contained) in the electroconductive resin layer forming the surface layer 2*c*, organic particles or inorganic particles which are insulating particles ($10^{10}$ Ω·cm or more) other than the above-described electroconductive agents can be used. As the organic particles, particles of acrylic resin material, acryl-styrene copolymer resin material, polyamide resin material, silicone rubber, epoxy resin material and the like can be cited. Of these particles, it is particularly preferable that the particles of acrylic resin material or acryl-styrene copolymer resin material is used since rigidity of the material is not so changed. As the inorganic particles, for example, particles of calcium carbonate, clay, talc, silica and the like can be cited. Incidentally, in the case where the inorganic particles are used in a solvent-based paint, it is preferable that the inorganic particles are subjected to hydrophobic surface treatment so as to be easily dispersed in the paint. Further, also as regards the organic particles, similarly, organic particles having a good compatibility with the resin material of the surface layer 2*c* may preferably be selected since the particles do not readily cause agglomeration. In this embodiment, a contact area ratio α described later is controlled by the surface particles 21 dispersed in the surface layer 2*c*. An average particle size of the surface particles can be appropriately selected within a range of about 2-30 μm. In this embodiment, the average particle size of the surface particles 21 is 5 μm.

Incidentally, the average particle sizes of the surface particles 21 is a center particle size and can be measured by the following method. As a measuring device, a Coulter Counter ("Multisizer type II", mfd. by Beckman Coulter Inc.) is used. Further, an interface (mfd. by Nikkaki Bios Co., Ltd.) and a personal computer ("CX-1", mfd. by Canon K.K.) for outputting the number and volume average distributions of the particles are connected with the Coulter Counter. As an electrolytic aqueous solution, 1% NaCl aqueous solution prepared by using a first class grade sodium chloride is prepared. As a measuring method, 0.1-5 ml of a surfactant, preferably alkyl-benzene sulfonate, is added, as dispersant, into 100-150 ml of above-mentioned electrolytic aqueous solution. Then, 2-20 mg of a measuring sample is added to the above mixture. Then, the electrolytic aqueous solution in which the sample is suspended is subjected to dispersion by an ultrasonic dispersing device for about 1-3 minutes. Then, the measurement was carried out with the use of the Coulter Counter (Multisizer type II) fitted with a 100 μm aperture as an aperture. Volumes and numbers of the particles to be measured were measured, so that a volume distribution and a number distribution are calculated. Then, a particle size $D_{50}$ of 50% of a volume-basis particle distribution can be used as a center particle size as an average particle size.

A method of forming the surface layer 2*c* is not particularly limited, but a method in which a paint containing respective ingredients is prepared and then a film (layer) of the paint is applied onto the base layer 2*b* by a dipping method or a spraying method may preferably be used. In this embodiment, the surface particles 21 were mixed and dispersed in the resin material forming the surface layer 2*c* and then the mixture was coated on the surface of the base layer 2*b* through spray coating, so that the surface layer 2*c* was formed.

3. Elastic Deformation Rate (Elastic Deformation Power) of Photosensitive Drum

In this embodiment, the photosensitive drum 1 includes the protective layer 1*d* formed as the outermost layer by using the curable material.

In this embodiment, an elastic deformation rate of the surface of the photosensitive drum 1 is 47% or more (particularly, 48% in this embodiment). As a result, abrasion of the surface of the photosensitive drum 1 due to friction between the surface of the photosensitive drum 1 and the cleaning blade 6*a* is suppressed, so that lifetime extension of the photosensitive drum 1 is realized.

The elastic deformation rate is a value measured using a microhardness measuring device ("FISHER SCOPE H100V", manufactured by Fisher Instruments K.K.) in an environment of 25° C./50% RH (relative humidity). This device is capable of acquiring a continuous hardness by causing a penetrator (indenter) to contact a measuring object (surface of the photosensitive drum 1) and then by directly reading an indentation depth under a load continuously exerted on the penetrator (indenter). As the indenter, a Vickers quadrangular pyramid diamond indenter with an angle between opposite forces of 136 degrees is used. A final load continuously exerted on the indenter is 6 mN, a retention time in which a state that the final load of 6 mN is exerted on the indenter is retained was 0.1 sec. Further, the number of measuring points was 273 points.

FIG. 4 is a graph for illustrating a measuring method of the elastic deformation rate of the surface of the photosensitive drum 1. In FIG. 4, the ordinate represents a load F (mN) exerted on the penetrator (indenter), and the abscissa represents an indentation depth h (μm) of the penetrator (indenter). FIG. 4 shows a result when the load exerted on the indenter is stepwisely increased up to a maximum (6 mN in this case) (A to B), and then is stepwisely decreased (B to C). The elastic deformation rate can be acquired from a change in amount of work (energy) of the indenter on the measuring object (surface of the photosensitive drum 1), i.e., a change in energy caused by increase and decrease of the load of the indenter on the measuring object (surface of the photosensitive drum 1). Specifically, a value obtained by dividing an elastic deformation work amount We by an entire work amount Wt (We/Wt) is the elastic deformation rate (EL deformation power) (represented by percentage (%)). The entire work amount Wt is represented by an area of a region enclosed by A-B-D-A in FIG. 4, and the elastic deformation work amount We is represented by an area of a region enclosed by C-B-D-C in FIG. 4.

When the elastic deformation rate of the surface of the photosensitive drum 1 is excessively small, an elastic force of the surface of the photosensitive drum 1 is insufficient, so that abrasion of the surface of the photosensitive drum 1 is liable to generate at a contact portion between the photosensitive drum 1 and a contact member such as the cleaning blade 6*a*. The elastic deformation rate of the surface of the photosensitive drum 1 as measured in the above-described method is 48%. The photosensitive drum 1 including the protective layer 1*d* and having the elastic deformation rate of 48% was subjected to evaluation of durability under a predetermined condition. As a result, abrasion (wearing) of the surface of the photosensitive drum 1 was 0.5 μm per print number of 100,000 sheets. On the other hand, as a result that the durability evaluation of a photosensitive drum 1 in a comparison example in which the protective layer 1*d* was not provided and the elastic deformation rate of the surface of the photosensitive drum 1 was 46% was performed under the same condition, the abrasion of the surface of the photosensitive drum 1 was 1.0 μm per print number of 10,000 sheets. that is, it turned out that the photosensitive drum 1 in the comparison example was easily abraded 20 times more than the photosensitive drum 1 in this embodiment. In this embodiment, a thickness of the protective layer 1*d* is 3.0 μm. Accordingly, in this embodiment, the print number in which the photosensitive drum 1 reaches an end of a lifetime thereof is about 500,000 sheets. Further, as a result that the durability evaluation of the photosensitive drum 1 in this embodiment in which the elastic deformation rate of the photosensitive drum surface was 47% was performed under the same condition, it turned out that the surface of the photosensitive drum 1 in this embodiment was not readily abraded 10 times or more compared with the photosensitive drum 1 in the comparison example and thus lifetime extension of the photosensitive drum 1 can be sufficiently realized.

From this result, in the case where the elastic deformation rate of the surface of the photosensitive drum 1 is 47% or more, it turned out that the abrasion of the surface of the photosensitive drum 1 can be sufficiently suppressed and thus the lifetime of the photosensitive drum 1 can be sufficiently extended.

Further, when the elastic deformation rate of the surface of the photosensitive drum 1 is excessively large, an amount of plastic formation of the surface of the photosensitive drum 1 also becomes large, so that minute scars on the surface of the photosensitive drum 1 are liable to generate at a contact portion between the photosensitive drum 1 and a contact member such as the cleaning blade 6*a*. According to study by the present inventors, it turned out that the elastic deformation rate of the surface of the photosensitive drum 1 may preferably be 60% or less. Incidentally, the elastic deformation rate of the surface of the photosensitive drum 1 can be adjusted depending on a combination of a material with a manufacturing condition.

4. Charge Injection Phenomenon

As described above, in the constitution in which the photosensitive drum 1 includes the protective layer 1*d*, the surface abrasion of the photosensitive drum 1 is suppressed and the lifetime extension of the photosensitive drum 1 can be realized. However, in the case where the surface abrasion of the photosensitive drum 1 is suppressed as described above, even when the DC charging type is employed, an image defect resulting from a charge injection phenomenon generates due to the discharge product deposited on the photosensitive drum 1 in some instance.

That is, the discharge product deposited on the surface of the photosensitive drum 1 by the electric discharge has a high deliquescent property that the discharge product is liable to absorb water content principally in a high-humidity environment, so that the discharge product absorbed the water content lowers a surface resistance of the photosensitive drum 1. Particularly, in a constitution employing the AC charging type, a discharge amount is relatively large, and therefore, the discharge product is deposited in a relatively large amount on the surface of the photosensitive drum 1, and thus the surface of the photosensitive drum 1 is lowered in resistance, so that an "image flow" that the electrostatic image flows. On the other hand, in the DC charging type, compared with the AC charging type, the discharge amount is small, and therefore, the amount of the discharge product deposited on the surface of the photosensitive drum 1 is relatively small. For that reason, in the constitution employing the DC charging type, a degree of the lowering in surface resistance of the photosensitive drum 1 is relatively small, so that the "image flow" considerably disturbing the image does not occur. However, even in the constitution employing the DC charging type in which the depositing amount of the discharge product on the surface of the photosensitive drum 1 is relatively small, in some cases, a "charge injection phenomenon" in which the image is disturbed occurs. This charge injection phenomenon is a phenomenon occurring irrespective of the discharge at the contact portion between the charging roller 2 and the photosensitive drum 1 due to a potential difference between the surface potential of the charging roller 2 and the surface potential of the photosensitive drum 1. Incidentally, the charge injection phenomenon occurs at the charging nip N when being observed macroscopically, but occurs at an actual contact portion between the charging roller 2 and the photosensitive drum 1 in the charging nip N when being microscopically observed. This will be specifically described later. According to study by the present inventors, it turned out that in addition to the potential difference between the charging roller 2 and the photosensitive drum 1, also a magnitude of an area (contact area) of the actual contact portion between the charging roller 2 and the photosensitive drum 1 has a large influence on a degree of occurrence of the charge injection phenomenon. This will also be described specifically later.

An environment in which the above-described charge injection phenomenon is liable to occur is principally the high-humidity environment. For example, the environment is the case where the image forming apparatus 100 is disposed in an environment of a temperature of 30° C. and a relative humidity of 80% RH. Here, in this embodiment, the photosensitive drum 1 is warmed to about 38° C. by a heater (not shown) provided in the neighborhood of the photosensitive drum 1, so that an amount of the water content absorbed by the discharge product at the surface of the photosensitive drum 1 is decreased. However, even under a condition such that the heater is provided, the charge injection phenomenon occurs in some cases.

In the case of the photosensitive drum 1 in this embodiment in which the protective layer 1*d* is provided and the surface elastic deformation rate is 48% and in the photosensitive drum 1 in the case of the comparison example in which the protective layer 1*d* is not provided and the surface elastic deformation rate is 46%, a degree of occurrence of the image defect due to the charge injection phenomenon was checked. As a result, in the case of the photosensitive drum 1 in this embodiment, the image defect due to the charge injection phenomenon occurred in some instances. This result will be specifically described later with reference to Table 2 appearing hereinafter. On the other hand, in the case of the photosensitive drum 1 in the comparison example, the image defect did not occur. This is because the photosensitive drum 1 in the comparison example is easily abraded more than the photosensitive drum 1 in this embodiment and therefore the discharge product deposited on the surface of the photosensitive drum 1 is easily removed by the cleaning blade 6*a* or the like.

5. Measuring Method of Charge Injection Amount

Next, a method of analyzing the charge injection phenomenon through digitization will be described.

The charge injection phenomenon occurs irrespective of the discharge, and therefore, there is a need that a measurement of a charge injection amount is made under a condition in which the surface potential of the photosensitive drum 1 is not changed by the discharge. For this reason, a relationship between the voltage applied to the charging roller 2 and the surface potential Vd of the photosensitive drum 1 is acquired in advance. As described above with reference to FIG. 3, in this embodiment, the discharge start voltage Vth is −600 V. Accordingly, the voltage applied to the charging roller 2 in order to measure the charge injection amount was set to values, smaller than the discharge start voltage in absolute value, for example, −100 V, −300 V and −500 V. A procedure for measuring the charge injection amount will be described below.

First, the surface potential of the photosensitive drum 1 is set at substantially 0 V. In this case, the surface potential of the photosensitive drum 1 may be made substantially 0 V by discharging the photosensitive drum surface by a discharging means (such as a discharging lamp). Thereafter, rotational drive of the photosensitive drum 1 is started. Then, a voltage of −100 V is applied to the charging roller 2. Then, for about 2 seconds, the surface potential of the photosensitive drum 1 changing when the voltage is applied to the charging roller 2 is measured by a potential sensor. At this time, with respect to the rotational direction of the photosensitive drum 1, at a position downstream of the charging nip N and upstream of, for example, a position corresponding to the developing portion, the surface potential of the photosensitive drum 1 is measured.

FIG. 5 is a charging roller showing an amount of a change in surface potential of the photosensitive drum 1 measured in the above-described manner. The charge injection phenomenon occurs when the surface of the potential 1 passes through the charging nip N. For that reason, in this embodiment, an amount of a change in surface potential of the photosensitive drum 1 converted into a time in which the surface of the photosensitive drum 1 passes through the charging nip N (herein, this amount is referred to as a "charge injection potential ΔVd") is calculated. This charge injection potential ΔVt, i.e., the amount of the change in surface potential of the photosensitive drum 1 per time when the surface of the photosensitive drum 1 passes though the charging nip N may preferably be acquired from a measurement result of the surface potential change amount in a period in which the surface potential of the photosensitive drum 1 changes substantially linearly. For example, as shown in FIG. 5, from a measurement result of the surface potential change amount of the photosensitive drum 1 measured in a time from a start of the rotational drive of the photosensitive drum 1 until the photosensitive drum 1 rotates through one full circumference (one full turn), the charge injection potential ΔVd can be acquired. Further, the time in which the surface of the photosensitive drum 1 passes through the charging nip N can be acquired from the peripheral speed of the photosensitive drum 1 and a width of the charging nip N with respect to the rotational direction of the photosensitive drum 1.

Then, the voltage applied to the charging roller 2 is changed to −300 V and −500 V, and then the above-described procedure is repeated. As a result, a relationship between the charge injection potential ΔVd and a potential difference ΔVa between the surface potential of the photosensitive drum 1 and the surface potential of the charging roller 2 is obtained. FIG. 6 is a graph showing an example of the relationship between the charge injection potential ΔVd and the potential difference ΔVa acquired as described above.

FIG. 7 is a schematic view for illustrating an electric discharge phenomenon and the charge injection phenomenon between the charging roller 2 and the photosensitive drum 1. The discharge between the charging roller 2 and the photosensitive drum 1 is almost carried out in the upstream charging gap portion A1. In the case where a voltage of −1300 V is applied to the charging roller 2, the surface of the photosensitive drum 1 is charged to −700 V in the upstream charging gap portion A1. For this reason, in the charging nip N, the surface potential of the charging roller 2 is −1300 V and the surface potential of the photosensitive drum 1 is −700 V, so that the potential difference ΔVa between the surface potentials of the charging roller 2 and the photosensitive drum 1 is 600 V. Then, from the relationship between the potential difference ΔVa and the charge injection potential ΔVd (FIG. 6), the charge injection potential ΔVd when the potential difference ΔVa between the surface potential of the charging roller 2 and the surface potential (0 V in this embodiment) in the charging nip N is 600 V can be calculated.

The charge injection potential ΔVd of the photosensitive drum 1 in this embodiment, acquired in the above-described method, in which the protective layer 1*d* is provided and the surface elastic deformation rate is 48% was 15.4 V. On the other hand, the charge injection potential ΔVd of the photosensitive drum 1 in the comparison example in which the protective layer 1*d* is not provided and the surface elastic deformation rate is 46% was 3.0 V. Incidentally, in this case, the charging roller 2 was 15 mm in outer diameter and 1.0 μm in surface roughness (ten-point average roughness Rz). Further, the charge injection potentials ΔVd are values measured after a durability test similar to that described later.

6. Suppression of Image Defect Due to Charge Injection Phenomenon

By study of the present inventors, it turned out that the magnitude of the area (contact area) of the actual contact portion between the charging roller 2 and the photosensitive drum 1 has a large influence on a degree of occurrence of the charge injection phenomenon. Therefore, in the present invention, the image defect due to the charge injection phenomenon is suppressed by controlling the contact width and the contact area ratio between the charging roller 2 and the photosensitive drum 1.

<Contact Width and Contact Area Ratio>

First, the contact width and the contact area ratio between the charging roller 2 and the photosensitive drum 1 will be described.

The charging roller 2 and the photosensitive drum 1 are in contact to each other in the charging nip N when being observed macroscopically. However, when the charging roller 2 and the photosensitive drum 1 are observed microscopically, by the influence of minute unevenness (projections and recesses) of the surface of the charging roller 2, the area of the actual contact portion between the charging roller 2 and the photosensitive drum 1 is somewhat smaller than an entire area of the charging nip N.

A measuring device and a measuring method which are used for measuring the actual contact portion between the charging roller 2 and the photosensitive drum 1 will be described. FIG. 8 is a schematic view showing a schematic structure of the measuring device. First, the charging roller 2 is contacted to a flat glass plate substantially in the same condition as that during image formation (particularly in a condition in which a contact width X described later is substantially equal to the width of the charging nip N with respect to the rotational direction of the photosensitive drum 1 during the image formation). In this case, the charging roller 2 is contacted to the glass plate under a load of 600 gf exerted on each of end portions of the supporting member 2*a* of the charging roller 2 by the urging spring 2*e* with respect to the rotational axis direction. Further, on a side opposite from the charging roller 2 with respect to the glass plate, a camera is provided, and then the glass plate is irradiated with light from an oblique direction to a rectilinear line connecting the charging roller 2 and the camera. The contact portion between the charging roller 2 and the glass plate absorbs the light and appears as a black point, and therefore, can be distinguished from a non-contact portion between the charging roller 2 and the photosensitive drum 1. FIG. 9 is a schematic view showing a still image captured by the camera.

Here, a width (distance) of the contact portion, between the charging roller 2 and the glass plate, along the rotational direction of the charging roller 2 (i.e., a direction substantially perpendicular to the rotational axis direction) is referred to as the "contact width X (mm)". This contact width X corresponds to a width of the charging nip N with respect to the rotational direction of the photosensitive drum 1. Further, an area ratio (proportion) per unit area of the actual contact portion (black point) between the charging roller 2 and the glass plate is referred to as the "contact area ratio α". The contact area ratio α can be calculated by image processing of the still image, as shown in FIG. 9, obtained by the above-described measuring device and method. In this case, a ratio of the area of the black points to an entire area in a region of the contact width X (this area may be an entire area of a region of the contact width X in the captured image) can be calculated. Or, in order to sufficiently represent the contact area ratio α in the region of the contact width X, a contact area ratio α at a part of a predetermined area may be calculated, or an average may also be acquired by calculation of contact area ratios α at a plurality of parts of the predetermined area. For example, the contact area ratio α in the case where the black points are positioned over an entire area of the region of the contact width X is "1", and the contact area ratio α in the case where the black points are positioned in ½ of the entire area of the region of the contact width X is "0.5".

<Contact Area Ratio, Contact Width and Charge Injection Amount>

Next, a relationship among the contact area ratio and the contact width between the charging roller 2 and the photosensitive drum 1, and the charge injection amount will be described.

Table 1 shows a result of measurement of the charge injection potential ΔVd when the contact width X and the contact area ratio α are changed. The contact width X was controlled by changing the outer diameter of the charging roller 2. The contact area ratio α was controlled by changing the amount of the surface particles 21 dispersed in the surface layer 2*c* of the charging roller 2. Further, for convenience, in Table 1, the contact area ratio α is represented by a percentage (%).

TABLE 1

| CRD*1 (mm) | CW*2 X (mm) | CAR*3 α(%) | X (mm) x α(%) | CIP*4 ΔVd(V) |
|---|---|---|---|---|
| 11 | 0.2 | 0.5 | 0.0010 | −2.8 |
| 11 | 0.2 | 1.0 | 0.0020 | −4.8 |
| 11 | 0.2 | 4.0 | 0.0080 | −7.8 |
| 11 | 0.2 | 10.0 | 0.0200 | −9.8 |
| 11 | 0.2 | 40.0 | 0.0800 | −13.1 |
| 12 | 0.3 | 0.5 | 0.0015 | −3.8 |
| 12 | 0.3 | 1.0 | 0.0030 | −4.6 |
| 12 | 0.3 | 4.0 | 0.0120 | −7.8 |
| 12 | 0.3 | 10.0 | 0.0300 | −9.8 |
| 12 | 0.3 | 40.0 | 0.1200 | −12.3 |
| 13 | 0.5 | 0.5 | 0.0025 | −4.8 |
| 13 | 0.5 | 1.0 | 0.0050 | −6.8 |
| 13 | 0.5 | 4.0 | 0.0200 | −8.3 |
| 13 | 0.5 | 10.0 | 0.0500 | −10.8 |
| 13 | 0.5 | 40.0 | 0.2000 | −14.0 |
| 14 | 0.6 | 10.0 | 0.0600 | −12.0 |
| 15 | 0.7 | 40.0 | 0.2800 | −15.4 |

*1"CRD" is the charging roller diameter.
*2"CW" is the contact width.
*3"CA" is the contact area ratio.
*4"CIP" is the charge injection potential.

FIG. 11 is a graph showing a result of study of a relationship between the charge injection potential ΔVd and a product of the contact width X and the contact area ratio α. In FIG. 11, the abscissa represents the product of the contact width X and the contact area ratio α, and the ordinate represents the charge injection potential ΔVd. From FIG. 11, it is understood that the product of the contact width X and the contact area ratio α, and the charge injection potential ΔVd have a substantially linear relationship. That is, the charge injection amount can be decreased with a decreasing contact area ratio α and can also be decreased with a decreasing contact width X.

Here, Table 2 below shows a result of study of a degree of the image defect appearing on an actually outputted image on the toner image receiving material P in the case where the charge injection potential ΔVd is changed. In this embodiment, a durability test in which images each having an image ratio of 5% were continuously printed on 100,000 sheets in a high temperature/high humidity environment (30° C./80% RH) was conducted. After the durability test, in the same environment (30° C./80% RH), as evaluation images, three kinds of images consisting of character images, halftone images and solid images were outputted, and a degree of generation of stripe-shaped image density non-uniformity (white stripe) due to the charge injection phenomenon was checked by eye observation. Evaluation was performed in the following manner. The case where a white stripe generated to a degree which cannot be practically accepted was evaluated as "x (unacceptable)", the case where a slight white stripe generated in some instances but was a practically acceptable degree was evaluated as "▲ (acceptable)", and the case where no white stripe generated was evaluated as "◎ (good)".

TABLE 2

| ΔVd | CHARACTER | HALFTONE | SOLID |
|---|---|---|---|
| 4 V | ◎ | ◎ | ◎ |
| 7 V | ◎ | ◎ | ◎ |
| 10 V | ◎ | ◎ | ◎ |
| 13 V | ◎ | ▲ SWS*1 | ◎ |
| 20 V | ◎ | x WS*2 | ▲ SWS*1 |

*1"SWS" represents that a slight white stripe generated.
*2"WS" represents that a white stripe generated.

From Table 2, it is understood that when an absolute value of the charge injection potential ΔVd is 13 V or less, the image is not largely disturbed by the charge injection phenomenon.

From the results of Tables 1 and 2, by making the product of the contact width X (mm) and the contact area ratio α 0.1 or less, the absolute value of the charge injection potential ΔVd can be made 13 V or less, so that the image defect due to the charge injection phenomenon can be sufficiently suppressed. The image defect due to the charge injection phenomenon can be sufficiently suppressed by setting the contact width X (mm) and the contact area ratio α so as to satisfy the following relationship: (Contact width X)×(Contact area ratio α)≤0.1 mm. Further, from the results of Tables 1 and 2 and FIG. 11, in order to suppress the image defect due to the charge injection phenomenon with high reliability, the product of the contact width X (mm) and the contact area ratio α may preferably be made 0.05 mm or less.

Incidentally, it would be considered that as regards the product of the contact width X (mm) and the contact area ratio α, a difference within about ±0.03 in an error range, and it would be also considered that as regards the absolute value (V) of the charge injection potential ΔVd, a difference within about ±0.3 V is an error range. Further, the contact width X is 0.2 mm or more in general from such a viewpoint that the charging roller 2 may preferably be urged (pressed) against the surface of the photosensitive drum 1 to some extent for the purpose of stabilizing the charging process of the photosensitive drum 1 by stabilizing the charging gap portion. Further, for a production reason of the charging roller 2, the contact area ratio α is 0.005 (=0.5%) or more.

<Surface Roughness of Charging Roller>

FIG. 12 is a graph showing a relationship of study of a relationship between surface roughness (ten-point average roughness Rz) and the contact area ratio α when the contact area ratio α is changed similarly as in the above-described case (for convenience, the contact area ratios α in the figure are represented by the percentage). From FIG. 12, it is understood that a correlation between the surface roughness Rz of the charging roller 2 and the contact area ratio α is low and therefore it is difficult to control the charge injection potential ΔVd only by adjusting the surface roughness Rz of the charging roller 2. This would be considered because the charge injection potential ΔVd is influenced by hardness or the like of the surface particles 21 added in the surface layer 2*c* of the charging roller 2.

Incidentally, a measuring device and a measuring condition which are used for measuring the surface roughness of the charging roller 2 are as follows. As the measuring device, a contact surface roughness measuring device manufactured by Kosaka Laboratory Ltd is used. The measuring condition was in accordance with JIS 1994, and included a longitudinal magnification power of 5,000, a lateral magnification power of 50, a measuring length of 8 mm, a speed of 0.5 mm/s, and a measuring direction taken along the rotational axis direction of the charging roller 2.

As described above, in this embodiment, the surface roughness Rz of the charging roller 2 is not controlled, but the contact width X and the contact area ratio α are controlled by the outer diameter of the charging roller 2 and the surface particles 21 dispersed in the surface layer 2*c* of the charging roller 2. As a result, the charge injection phenomenon is suppressed, so that the image defect due to the charge injection phenomenon can be sufficiently suppressed.

Incidentally, in this embodiment, the unevenness (projections and recesses) is formed at the surface of the charging roller 2 by dispersing the surface particles 21 in the surface layer 2*c* of the charging roller 2, and thus the contact area ratio is controlled, but a method of forming the unevenness at the surface of the charging roller 2 is not limited to a method of dispersing the surface particles 21. For example, the unevenness may be formed by molding during or after formation of the surface layer 2*c* of the charging roller 2, or may also be formed by polishing the surface of the charging roller 2.

Embodiment 2

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

In this embodiment, at the surface of the protective layer 1*d* of the photosensitive drum 1, a plurality of independent recesses (recessed portions) are provided. Further, in this embodiment, the contact width X and the contact area ratio α are controlled by the outer diameter of the charging roller 2 and the surface recesses of the photosensitive drum 1.

When the hardness of the surface layer of the photosensitive drum 1 is increased (low wearing degree), a frictional force between the photosensitive drum 1 and the cleaning blade 6*a* increases, so that the shuddering (abnormal vibration), the turning-up (phenomenon that a free end of the cleaning blade 6*a* is turned up with respect to the rotational direction of the photosensitive drum 1), chipping and abrasion (wearing) of the cleaning blade 6*a* are liable to generate. Therefore, in order to suppress the above inconveniences by controlling the frictional force between the photosensitive drum 1 and the cleaning blade 6*a*, the surface of the photosensitive drum 1 is provided with a plurality of independent recesses (recessed portions) (Japanese Patent No. 4101278).

In this embodiment, the surface of the photosensitive drum 1 can be provided with the recesses on the basis of the above known constitution. Incidentally, a specific example of the recesses formed at the surface of the photosensitive drum 1 is arbitrarily applied, so that this embodiment is applicable to image forming apparatuses 100 including photosensitive drums 1 provided with recesses having various shapes.

Typically, the recesses are provided so that when a square region having one side is parallel to the rotational direction of the develop and having each side of 500 μm (500 μm×500 μm) is provided at an arbitrary position of the surface of the photosensitive drum 1, an areal ratio of the specific recesses satisfying a predetermined condition in this region is a predetermined value. The shape of the surface recesses of the photosensitive drum 1 described below shows a preferred example and is not limited to the following shape.

First, an observation method of specific recesses of the surface of the photosensitive drum 1 will be described. The specific recesses of the surface of the photosensitive member can be observed using a microscope such as a laser microscope, an optical microscope, an electron microscope or an atomic force microscope.

As the laser microscope, e.g., the following devices are available: an ultra-deep shape measurement microscope "VK-8550", an ultra-deep shape measurement microscope "VK-9000", and ultra-deep shape measurement microscope "VK-9500", "VK-X200" and "VK-X100" manufactured by Keyence Corp.; a confocal laser scanning microscope "OLS3000" manufactured by Olympus Corp.; and a real color confocal microscope "Optelics C130" manufactured by Lasertec Corp.

As the optical microscope, e.g., the following devices are available: a digital microscope "VHX-500" and a digital microscope "VHX-200" manufactured by Keyence Corp.; and a 3D digital microscope "VC-7700" manufactured by Omron Corp.

As the electron microscope, e.g., the following devices are available: a 3D real surface view microscope "VE-9800" and a 3D real surface view microscope "VE-8800" manufactured by Keyence Corp.; a scanning electron microscope "Conventional/Variable Pressure SEM" manufactured by SII Nano Technology Inc.; and a scanning electron microscope "SUPERSCAN SS-550" manufactured by Shimadzu Corp.

As the atomic force microscope, e.g., the following devices are available: a nano-scale hybrid microscope "VN-8000" manufactured by Keyence Corp.; a scanning probe microscope "Nano Navi Station" manufactured by SII Nano Technology Inc.; and a scanning probe microscope "SPM-9600" manufactured by Shimadzu Corp.

Observation of the square region with one side of 500 μm described above may be performed at a magnification such that the square region with one side of 500 μm falls within an observation region or may also be performed in such a manner that partial observation is made at a higher magnification and thereafter a plurality of partial images are connected using a software or the like.

Next, the specific recesses in the square region (500 μm×500 μm) will be described. First, the surface of the photosensitive drum 1 is observed with the microscope in an enlarged manner. The surface of the photosensitive drum 1 is a curved surface such that the photosensitive drum surface is curved along a circumferential direction, and therefore, a cross-sectional profile of the curved surface is extracted and the curved line (arc) is subjected to fitting. FIG. 13 is an example of the fitting. The example shown in FIG. 13 is an example of the case where the photosensitive drum 1 has a cylindrical shape. In FIG. 13, a solid line 101 is the cross-sectional profile of the surface (curved surface, peripheral surface) of the photosensitive drum 1, and a broken line 102 is a curved line fitted to the cross-sectional profile 101. The cross-sectional profile 101 is corrected so that the curved line 102 is changed to a rectilinear line, and a resultant rectilinear line is extended in the rotational axis direction (direction perpendicular to the circumferential direction) of the photosensitive drum 1, so that a resultant plane is used as a reference plane. Also in the case where the shape of the photosensitive drum 1 is not the cylindrical shape, similarly as in the case where the photosensitive drum 1 has the cylindrical shape, the reference plane is obtained. Portions positioned under the resultant reference plane are specific recesses (recessed portions) in the square region. A distance from the reference plane to a lowest point of the recesses is a depth of the recesses. In this embodiment, the depth of the specific recesses is 1.0 μm. Further, a cross-section of each of the recesses is an opening, and a length of the longest line segment of line segments crossing the opening in the rotational axis direction of the photosensitive drum 1 is a width of the opening of the recess.

In this embodiment, the width of the opening of each of the specific recesses is 40 μm. Incidentally, in this embodiment, the length of the longest line segments of line segments crossing the opening of each of the specific recesses in the circumferential direction of the photosensitive drum 1 is 80 μm. Further, in this embodiment, an area of the specific recesses in the square region (500 μm×500 μm) is 125,000 $\mu m^2$, so that an area ratio of the specific recesses in the square region is 50%. Incidentally, the areal ratio of the specific recesses is a proportion (represented by a percentage (%)) of a total of opening areas of the specific recesses to the sum of the total of opening areas of the specific recesses and a total of areas of portions other than the specific recesses.

Parts (a) and (b) of FIG. 14 are schematic views showing the shape of each of the specific recesses in this embodiment, in which part (a) shows a shape (surface shape as seen in a substantially perpendicular direction to the reference plane) of the opening on the reference plane, and part (b) shows a cross-sectional shape of the specific recess substantially parallel to the circumferential direction of the photosensitive drum 1. Incidentally, the cross-sectional shape of the specific recess shown in part (b) of FIG. 14 corresponds to the cross-sectional profile after the above-described correction.

First, the shape of the opening of the specific recess in this embodiment will be described. The specific recess includes an opening plane (surface) which is a phantom plane formed in the case where the specific recess is flushed with the reference plane. As shown in part (a) of FIG. 14, the opening of the specific recess in this embodiment has a shape such that a portion on one side with respect to the circumferential direction of the photosensitive drum 1 has an apex (point of intersection) formed by two rectilinear lines, and a portion on the other side has a semicircular shape. Further, the opening of the recess in this embodiment is such that when a rectilinear line A passes through the apex along the circumferential direction, a distance from an edge of the opening to the rectilinear line A gradually decreases from two points (two positions of the edge of the opening as two points of intersection of the opening edge and a broken line of a double-pointed arrow crossing the two points and the rectilinear line A) remotest from the rectilinear line A, toward the apex. In this embodiment, an angle θ1 formed by the rotational axis direction of the photosensitive drum 1 and each of the two rectilinear lines connecting the above-described two points (where a width of the opening becomes maximum) is 53°. As a result, a degree of the stripe-shaped image defect (initial stripe) which an generate in the high temperature/high humidity environment when stability of cleaning of the photosensitive drum 1 by the cleaning blade 6*a* lowers can be reduced. Incidentally, in the case where a line forming a contour of the opening of the recess is a curved line, when an angle formed between curved lines and an angle formed between the curved line and a rectilinear line are acquired, as regards the curved line, a tangential line thereof may only be required to be used.

Next, the cross-sectional shape of the specific recess substantially parallel to the circumferential direction of the photosensitive drum 1 will be described. As shown in part (b) of FIG. 14, the specific recess in this embodiment has a shape such that the portion on one side with respect to the circumferential direction of the photosensitive drum 1 has such a shape that a depth linearly shallows from the deepest point from the opening plane in a depth direction toward the above-described apex (point of intersection), and the portion on the other side has a partly domed shape. In this embodiment, when the specific recess is projected in the rotational axis direction of the photosensitive drum 1, an angle θ2 formed by a rectilinear line on the opening plane and a rectilinear line connecting the apex and the deepest point with respect to the depth direction is 2.9°.

Here, the surface recesses of the photosensitive drum 1 can be formed by a method in which a mold having a predetermined shape is press-contacted to the surface of the photosensitive drum 1, so that the shape is transferred onto the photosensitive drum surface. For example, the mold is continuously contacted to and pressed against the surface (peripheral surface) of the photosensitive drum 1 by a press-contact shape transfer processing device while rotating the photosensitive drum 1, so that the recesses can be formed. As another method, a method of forming specific-shaped recesses on the surface of the photosensitive drum 1 through laser irradiation or the like method is also known.

Incidentally, as regards the plurality of specific recesses provided on the peripheral surface of the photosensitive drum 1, all the specific recesses may have the same shape, maximum opening diameter and depth and may also include those having different shapes, maximum opening diameters and depths in mixture. Further, the shapes (both of the surface shape as seen in a direction normal to the surface of the photosensitive drum 1 and the cross-sectional shape substantially parallel to the circumferential direction of the photosensitive drum 1) of the specific recesses are not limited to those described in this embodiment, but may also be various arbitrary shapes as desired. As the shapes, for example, a circular shape, an elliptical shape, or polygonal shapes such as a square shape, a rectangular shape, a triangular shape, a quadrangular shape, a pentagonal shape and a hexagonal shape can be cited. Further, the specific recesses may be disposed in alignment with each other or may also be disposed randomly.

In this embodiment, the contact area ratio α between the photosensitive drum 1 and the charging roller 2 was able to be reduced to about 80% of the contact area ratio α in Embodiment 1 by providing the recesses having the above-described shape on the surface of the photosensitive drum 1. Incidentally, in this embodiment, the measurement of the contact area ratio α was performed similarly as in Embodiment 1 in a manner that the surface layer (protective layer 1*d*) of the photosensitive drum 1 was peeled off the photosensitive drum 1 and thereafter was applied onto the glass plate (FIG. 8) described in Embodiment 1.

Further, a degree of occurrence of the image defect due to the charge injection phenomenon was checked in a condition that the contact width X and the contact area ratio α were changed depending on the other diameter of the charging roller 2 and the number of the openings of the surface recesses of the photosensitive drum 1. Incidentally, in this embodiment, the surface layer 2*c* of the charging roller 2 was formed with nylon resin and in which the surface particles 21 were not dispersed. As a result, it turned out that the image defect due to the charge injection phenomenon can be sufficiently suppressed by making the product of the contact width X (mm) and the contact area ratio α 0.1 mm or less similarly as in the case of Embodiment 1. Further, it turned out that the image defect due to the charge injection phenomenon can be suppressed with high reliability by making the product of the contact width X (mm) and the contact area ratio α 0.05 mm or less.

As described above, in this embodiment, the surface roughness Rz of the charging roller 2 is not controlled, but the contact width X and the contact area ratio α are controlled by the outer diameter of the charging roller 2 and the surface particles 21 dispersed in the surface layer 2*c* of the charging roller 2. As a result, the charge injection phenomenon is suppressed, so that the image defect due to the charge injection phenomenon can be sufficiently suppressed.

Incidentally, the contact area ratio 6*a* & may also be controlled by controlling both of the surface shape of the charging roller 2 and the surface shape of the photosensitive drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-118137 filed on Jun. 15, 2017, which is hereby incorporated by reference herein in its entirety.

What is claimed is:

1. An image forming apparatus comprising:

a rotatable photosensitive member having a value, obtained by dividing an elastic deformation work amount by an entire work amount, of 47% or more;

a charging roller including an elastic layer and configured to electrically charge said photosensitive member under application of only a DC voltage, wherein said charging roller forms a nip with elastic deformation along the surface of said photosensitive member by being urged against said photosensitive member with a predetermined urging force, and in the nip, a surface of said charging roller and the surface of said photosensitive member are in contact to each other at a plurality of independent contact portions; and an image forming portion configured to form a toner image on said photosensitive member charged by said charging roller, wherein when a nip region corresponding to the nip is formed by urging the charging roller against a measuring contact member with the predetermined urging force and then an area of a plurality of independent contact portions at which the surface of said charging member and the measuring contact member are in contact to each other is measured, the following relationship is satisfied:

$$(\text{Contact width } X)\ (\text{mm}) \times (\text{Contact area ratio } \alpha) \leq 0.1\ (\text{mm}),$$

where a length from a position of one end to a position of the other end of the nip region with respect to a direction perpendicular to a longitudinal direction of said charging roller is the contact width X, and a ratio of a sum of areas ($mm^2$) of the independent contact portions to an entire area ($mm^2$) of a measuring region in which the independent contact portions are provided is the contact area ratio α, wherein the measuring region is a rectangular region in which one edge has a unit length (mm) extending in the longitudinal direction of said charging member and another edge has the contact width X (mm) extending in the direction perpendicular to the longitudinal direction of said charging roller and which falls within the nip region.

2. An image forming apparatus according to claim 1, wherein the following relationship is satisfied:

$$(\text{Contact width } X)\ (\text{mm}) \times (\text{Contact area ratio } \alpha) \leq 0.05\ (\text{mm}).$$

3. An image forming apparatus according to claim 1, wherein particles are dispersed in an outermost surface layer of said charging roller so as to satisfy the relationship.

4. An image forming apparatus according to claim 1, wherein a plurality of independent recesses are provided on the surface of said photosensitive member so as to satisfy the relationship.

5. A cartridge detachably mountable to a main assembly of an image forming apparatus, said cartridge comprising:

a rotatable photosensitive member having a surface having a value, obtained by dividing an elastic deformation work amount by an entire work amount, of 47% or more;

a charging roller including an elastic layer and configured to electrically charge said photosensitive member under application of only a DC voltage, wherein said charging roller forms a nip with elastic deformation along the surface of said photosensitive member by being urged against said photosensitive member with a predetermined urging force, and in the nip, a surface of said charging roller and the surface of said photosensitive member are in contact to each other at a plurality of independent contact portions, wherein when a nip region corresponding to the nip is formed by urging the charging roller against a measuring contact member with the predetermined urging force and then an area of a plurality of independent contact portions at which the surface of said charging member and the measuring contact member are in contact to each other is measured, the following relationship is satisfied:

$$(\text{Contact width } X)\ (\text{mm}) \times (\text{Contact area ratio } \alpha) \leq 0.1\ (\text{mm}),$$

where a length from a position of one end to a position of the other end of the nip region with respect to a direction perpendicular to a longitudinal direction of said charging roller is the contact width X, and a ratio of a sum of areas ($mm^2$) of the independent contact portions to an entire area ($mm^2$) of a measuring region in which the independent contact portions are provided is the contact area ratio α, wherein the measuring region is a rectangular region in which one edge has a unit length (mm) extending in the longitudinal direction of said charging member and another edge has the contact width X (mm) extending in the direction perpendicular to the longitudinal direction of said charging roller and which falls within the nip region.

6. A cartridge image according to claim 5, wherein the following relationship is satisfied:

$$(\text{Contact width } X)\ (\text{mm}) \times (\text{Contact area ratio } \alpha) \leq 0.05\ (\text{mm}).$$

7. A cartridge according to claim 5, wherein particles are dispersed in an outermost surface layer of said charging roller so as to satisfy the relationship.

8. A cartridge according to claim 5, wherein a plurality of independent recesses are provided on the surface of said photosensitive member so as to satisfy the relationship.

* * * * *